US010573446B2

(12) United States Patent
Smith

(10) Patent No.: US 10,573,446 B2
(45) Date of Patent: Feb. 25, 2020

(54) HOLDING TOOLS FOR PERMANENT MAGNETS AND METHODS TO USE THE SAME

(71) Applicant: Ford Global Technologies LLC, Dearborn, MI (US)

(72) Inventor: Nathan Gregory Smith, Werribee South (AU)

(73) Assignee: Ford Global Technologies LLC, Dearborn, MI (US)

( * ) Notice: Subject to any disclaimer, the term of this patent is extended or adjusted under 35 U.S.C. 154(b) by 116 days.

(21) Appl. No.: 15/851,183

(22) Filed: Dec. 21, 2017

(65) Prior Publication Data

US 2018/0211753 A1 Jul. 26, 2018

(30) Foreign Application Priority Data

Jan. 25, 2017 (CN) ..... 2017 1 0056309

(51) Int. Cl.
*H01F 7/20* (2006.01)
*B25B 23/12* (2006.01)
*B25B 11/00* (2006.01)

(52) U.S. Cl.
CPC ..... *H01F 7/206* (2013.01); *B25B 11/00* (2013.01); *B25B 23/12* (2013.01)

(58) Field of Classification Search
CPC ..... H01F 7/206
USPC ..... 335/289
See application file for complete search history.

(56) References Cited

U.S. PATENT DOCUMENTS 2,441,158 A * 5/1948 Krasnow ..... B23B 29/034 408/147
4,554,610 A * 11/1985 Metz ..... H01F 7/04 335/285
4,777,463 A * 10/1988 Cory ..... B23Q 3/1546 335/286
5,076,114 A * 12/1991 Moody ..... F16C 1/10 192/222
5,782,149 A 7/1998 Jensen
6,079,091 A 6/2000 Bove et al.
6,489,871 B1 * 12/2002 Barton ..... B25B 11/002 335/285
7,843,296 B2 * 11/2010 Fullerton ..... G09F 7/04 24/303
8,350,663 B1 * 1/2013 Michael ..... H01F 7/0226 338/288
8,544,918 B1 10/2013 Feringa
(Continued)

*Primary Examiner* — Shawki S Ismail
*Assistant Examiner* — Lisa N Homza
(74) *Attorney, Agent, or Firm* — Vichit Chea; Kolitch Romano LLP

(57) ABSTRACT

A holding tool to handle a first permanent magnet in a stack of permanent magnets is provided. The holding tool comprises a body including a holding portion including an electromagnet, and a switch disposed on the body and electrically connected to an electrical circuit of the electromagnet and configured to energize the electromagnet by connecting the electrical circuit and de-energize the electromagnet by disconnecting the electrical circuit. The holding portion includes a hollow member made of ferromagnetic material and a coil surrounding the hollow member to form the electromagnet and the electromagnet is configured to, when energized in a first current direction, have a polarity opposite to a polarity of the permanent magnets in the stack.

14 Claims, 6 Drawing Sheets

(56) References Cited

U.S. PATENT DOCUMENTS

| | | | | |
|---|---|---|---|---|
| 8,832,940 | B2 * | 9/2014 | Sarh | B21J 15/14 269/8 |
| 9,259,779 | B2 | 2/2016 | Sarh et al. | |
| 2004/0212471 | A1 * | 10/2004 | Day | B25B 11/002 335/285 |
| 2005/0017526 | A1 | 1/2005 | Arrotta | |
| 2005/0200143 | A1 | 9/2005 | Maestas | |
| 2009/0184789 | A1 * | 7/2009 | Lee | B23Q 3/1546 335/289 |
| 2009/0278643 | A1 * | 11/2009 | Helda | G01C 9/28 335/286 |
| 2011/0037547 | A1 * | 2/2011 | Cardone | B23Q 3/1543 335/290 |
| 2012/0256715 | A1 * | 10/2012 | Fullerton | H01F 7/021 335/285 |
| 2013/0135067 | A1 * | 5/2013 | Choi | B23Q 3/1543 335/290 |
| 2014/0043123 | A1 * | 2/2014 | Lee | B23Q 3/1543 335/285 |
| 2014/0361860 | A1 * | 12/2014 | Choi | H01F 7/04 335/295 |
| 2016/0005519 | A1 * | 1/2016 | Choi | H01F 7/0257 335/290 |

* cited by examiner

HOLDING TOOLS FOR PERMANENT MAGNETS AND METHODS TO USE THE SAME

RELATED APPLICATION

This application claims the benefit of Chinese Patent Application No.: CN 201710056309.6 filed on Jan. 25, 2017, the entire contents thereof being incorporated herein by reference.

FIELD

The present disclosure relates generally a tool to handle high strength magnets, in particular, relates to a holding tool to receive and secure a high strength magnet to a predetermined position.

BACKGROUND

High strength magnets such as neodymium magnets have many industrial uses. In some applications, a magnet needs to be picked up from a stored place such as a stack of magnets and moved to an intended place. However, it can be difficult to pull a selected magnet away from the stack due to strong magnetic field or attraction force between the magnets. It is more problematic if the selection and fixation of a magnet are steps of an assembly line because the long time needed to pick up the magnet will decrease the efficiency of the assembly line. Thus, there exists a need for a tool to handle the high strength magnet and reduce the time and effort to select a magnet from a stack of the magnets.

SUMMARY

According to one aspect, a holding tool to handle a first permanent magnet in a stack of permanent magnets is provided. The holding tool comprises a body including a holding portion, and the holding portion may be configured to receive the first permanent magnet and may include a hollow member made of ferromagnetic material and a coil surrounding the hollow member. The hollow member and the coil may form an electromagnet configured to, when energized in a first current direction, have a polarity opposite to a polarity of the permanent magnets in the stack. The holding portion may further comprise a switch disposed on the body and electrically connected to an electrical circuit of the electromagnet and configured to energize the electromagnet by connecting the electrical circuit and de-energize the electromagnet by disconnecting the electrical circuit.

In one embodiment, the body may further comprise a handle portion and a loading portion. The loading portion may be disposed between the handle portion and the holding portion and configured to preload a fastener.

In another embodiment, the loading portion may include at least one section elastically deformable or may include an accordion-shaped section along a length-wise direction of the holding tool, and the loading portion deforms when a force applies via the handle portion so that the fastener is capable of being pushing through a hole of the first permanent magnet.

In another embodiment, the holding tool may further comprise a container attached to the fastener and preloaded into the loading section. The container may include an explosive mixture and the ignition of the mixture may push the fastener into a hole of the first permanent magnet.

In another embodiment, the handle portion may be connected to the loading portion via thread connection and the rotation of the handle portion may drive the handling portion down against the fastener and pushes the fastener into a hole of the first permanent magnet.

In another embodiment, the holding tool may further comprise a spring between the handle portion and the holding portion and enclosing the loading portion. The loading portion may be formed as a thin-walled tube fixed on the holding portion and slidably connected to the handle portion, wherein the handle portion is configured to be capable of sliding down and up along the tube.

In another embodiment, the loading portion may include a plurality of sliders fixed on the holding portion, and each slider may have an elongated slot to receive a pin that is connected to the handle portion such that the handling portion is capable of moving up and down via movement of the pins in the slots, and a spring may be provided between the handle portion and the holding portion.

In another embodiment, the loading portion may include a plurality of scissors. Lower legs of scissors may be fixed on the holding portion and each of upper legs of scissors may have an elongated slot to receive a pin that is connected to the handle portion such that the handle portion is capable of moving up and down via movement of the pins in the slots. A spring may be provided to return the handle portion to an original position when a force applied by the handle portion is released.

In another embodiment, the loading portion may include a fastener holder to keep the fastener at a position above the holding portion and the fastener may be manually loaded on the fastener holder.

In another embodiment, the holding tool may further comprise an automatic fastener loader to feed the fastener via a slot in the loading portion automatically.

In another embodiment, a current in the coil, size and shape of the hollow member may be configured to generate a magnetic field to reduce a net pull force resulting from the permanent magnet received in the holding portion and the electromagnet to facilitate movement of the holding tool loaded with the permanent magnet away from the stack.

According to another aspect, a holding tool to handle a first permanent magnet from a stack of permanent magnets is provided. The holding tool comprises a DC power supply, a holding portion to receive and hold the permanent magnet; a loading portion connected to the holding portion and configured to preload and hold a fastener above the holding portion; a handle portion connected to the loading portion and configured to apply a force to the fastener. The holding portion may include a hollow member made of ferromagnetic material and a coil surrounding the hollow member. The coil may form an electrical circuit with the power supply. The hollow member, the coil and the power supply may form an electromagnet and the electromagnet may be configured to, when energized at a first current direction, have a polarity opposite to a polarity of the permanent magnets in the stack. The holding tool may include a switch disposed on the handle portion and configured to energize the electromagnet by connecting the electrical circuit and de-energize the electromagnet by disconnecting the electrical circuit.

In one embodiment, the electrical circuit may be configured to be capable of delivering the first current at different magnitudes and delivering a second current at a second direction reversal to the first direction. The switch may include a plurality of options and each option may deliver a specific amount of current so that a net pull force from the electrical magnet and the received first permanent magnet is different at the different options.

In another embodiment, the loading portion, the handle portion and the fastener may be made from non-ferromagnetic materials.

In another embodiment, the permanent magnet may be a neodymium magnet having a grade greater than N35.

According to another aspect, a method is provided to select a permanent magnet from a stack of permanents and move the permanent magnet to a predetermined place using a holding tool. The holding tool may comprise a holding portion including an electromagnet and a switch to energize and de-energize the electromagnet. The method comprises placing the holding portion over a first permanent magnet located at a stack of permanent magnets; receiving the first permanent magnet inside the holding portion; energizing the electromagnet by turning on the switch to generate a magnetic field that counter off a magnetic field from the stack of the permanent magnets so that the attraction force between the holding tool loaded with the first permanent magnet and the permanents at the stack is reduced; and moving the received permanent magnet away from the stack.

In one embodiment, the method may further comprise de-energizing the electromagnet while moving the received first permanent magnet to the predetermined place.

In another embodiment, the method may further comprise keeping the electromagnet energized while moving the received first permanent magnet to the predetermined place.

In another embodiment, the holding tool may further include a loading portion for a fastener. The method may further comprise preloading the fastener to the loading portion; and applying a force on the fastener to press the fastener through a hole of the first permanent magnet to secure the permanent magnet to the predetermined place when the permanent magnet is moved to the predetermined place.

In another embodiment, the method may further comprise reducing the current in the electrical circuit while moving the holding tool to the predetermined place; and de-energizing the electromagnet when the permanent magnet is moved to the predetermined place.

The holding tool of the present disclosure is advantageous because it can overcome the attraction from the stack of permanent magnets when selecting a permanent magnet from the stack to facilitate the selection process. Further, the holding tool is preloaded with a fastener so that the holding tool has a function of fastener driver to secure the selected permanent magnet to a predetermined place.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION

The disclosed holding tool for a permanent magnet will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various holding tools for a permanent magnet are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1A:
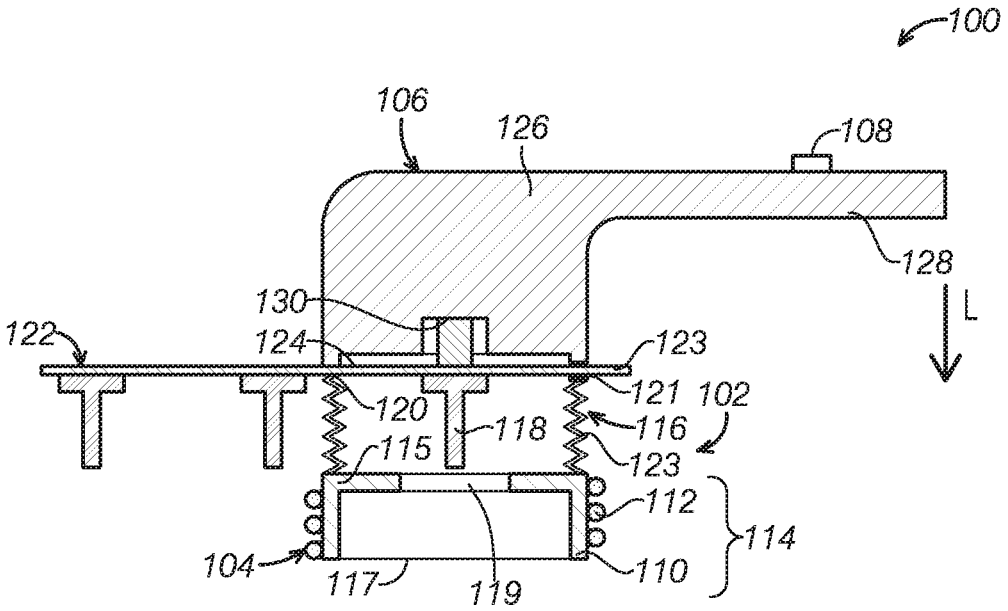
FIG. 1A is a schematic cross-sectional view of a holding tool for a permanent magnet according to one embodiment of the present disclosure, illustrating the holding tool at an unused state.

FIG. 1A is a schematic cross-sectional view of a holding tool 100 for a permanent magnet according to a first embodiment of the present disclosure, illustrating holding tool 100 at an unused state. Holding tool 100 may include a body 102 including a holding portion 104, a handle portion 106 and a switch 108. Holding portion 104 is configured to receive and hold a permanent magnet. In some embodiments, holding portion 104 may include a hollow member 110 made of ferromagnetic material and a coil 112 surrounding the hollow member 110. Hollow member 110 and coil 112 form an electromagnet 114. Electromagnet 114 is configured to generate magnetic field with desired polarity and magnitude of force when energized, which is described in detail in FIG. 2. It should be appreciated that holding portion 104 may include a case that encloses the electromagnet 114 (not shown).

Switch 108 is electrically connected to an electrical circuit including the coil and a power supply and configured to energize the electromagnet by connecting the electrical circuit and de-energize the electromagnet by disconnecting the electrical circuit. In some embodiments, switch 108 may be disposed on handle portion 106 for easy access by a user during an operation of holding tool 100. In the depicted embodiment, handle portion 106 may form an angle $\alpha$ with body 102. Angle $\alpha$ may be substantially 90 degrees or in a range of 85 degrees to 95 degrees. It should be appreciated that handle portion 106 may be any suitable configuration for the user to operate the holding tool. In some embodiments, switch 108 may be provided on a location adjacent to a place on which a user usually puts on his or her hand.

Hollow member 110 may have a cylindrical shape. The cross-section of the hollow member may have circular, hexagon or any suitable configuration that may match a shape of the permanent magnet. In some embodiments, holding portion 104 may further include partition plate 115 disposed away from an end 117 of holding portion 104. Partition plate 115 may be integrally formed with hollow member 110 or may be a separate piece made from different material. In the depicted embodiment, partition plate 115 includes a hole 119.

In some embodiments, body 102 may further include a loading portion 116 to preload or load a fastener 118. Loading portion 116 may include a slot 120 on a sidewall of loading portion 116 to load fastener 118. In some embodiments, an automatic fastener loader 122 may be attached to holding tool 100 to automatically feed fasteners 118 into loading portion 116. As shown in FIG. 1A, a plurality of fasteners may be attached to a fastener holder such as a membrane 124 and fed into loading portion 116 one by one. When fastener 118 is pushed down and separated from membrane 124, a portion 123 of used membrane can be taken away from an aperture 121 opposite to the slot 120 of loading portion 116. The automatic fastener loader 122 may be any suitable device conventionally used in the art to load fasteners such as screws into a fastener applicator (e.g., a screw loader of an electrical screwdriver). It should be appreciated that fastener 118 may be loaded into loading portion 116 manually.

In some embodiments, handle portion 106 may include a connection body 126 coupled with loading portion 116 and a handle 128. A driver head 130 may be provided on connection body 126 to drive fastener 118 downward. In some embodiments, driver head 130 may be driven manually via handle 128. In some embodiments, handle portion 106 may include an electric driver to move driver head 130 automatically.

In some embodiments, loading portion 116 may be made from elastic material that may be elastically deformed in a lengthwise direction L of holding tool 100. Alternatively, or additionally, loading portion may include an accordion segment 123 that can be extended and retracted in the direction L.

In some embodiments, loading portion 116, handle portion 106 and fastener 118 may be made from non-ferrous materials to avoid being affected by magnetic field from a permanent magnet and electromagnet.

Figure 1B:
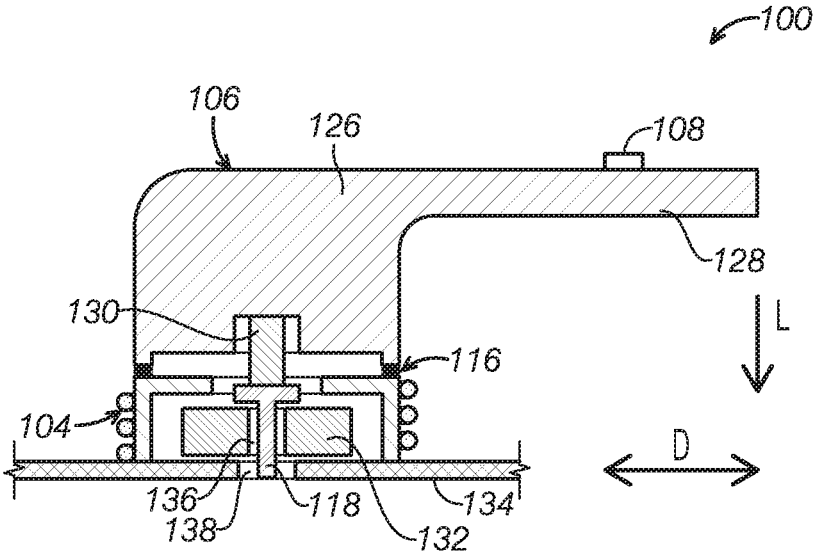
FIG. 1B is a schematic cross-sectional view of the holding tool for a permanent magnet in FIG. 1A, illustrating the holding tool at a state to secure a permanent magnet to a predetermined position via a preloaded fastener.

FIG. 1B illustrates holding tool 100 at a state to secure a permanent magnet 132 to a work piece 134. When a force is applied via handle 128, driver head 130 presses fastener 118 down to a hole 136 of permanent magnet 132 as loading portion 116 is shortened in the direction L and fastener 118 can be moved into a mounting hole 138 in workpiece 134. In some embodiments, workpiece 134 may be a metal piece and permanent magnet 132 may be attached to workpiece 134 securely in the direction L due to attraction force. Insertion of fastener 118 into mounting hole 138 prevents lateral movement of permanent magnet 132 on workpiece 134 in a direction D, which may be sufficient to secure permanent magnet 132 to workpiece 134. In some embodiments, an end portion of fastener 118 may include threads and mounting hole 138 may include matching threads. Permanent magnet 132 may be further secured by thread connection.

Figure 2:
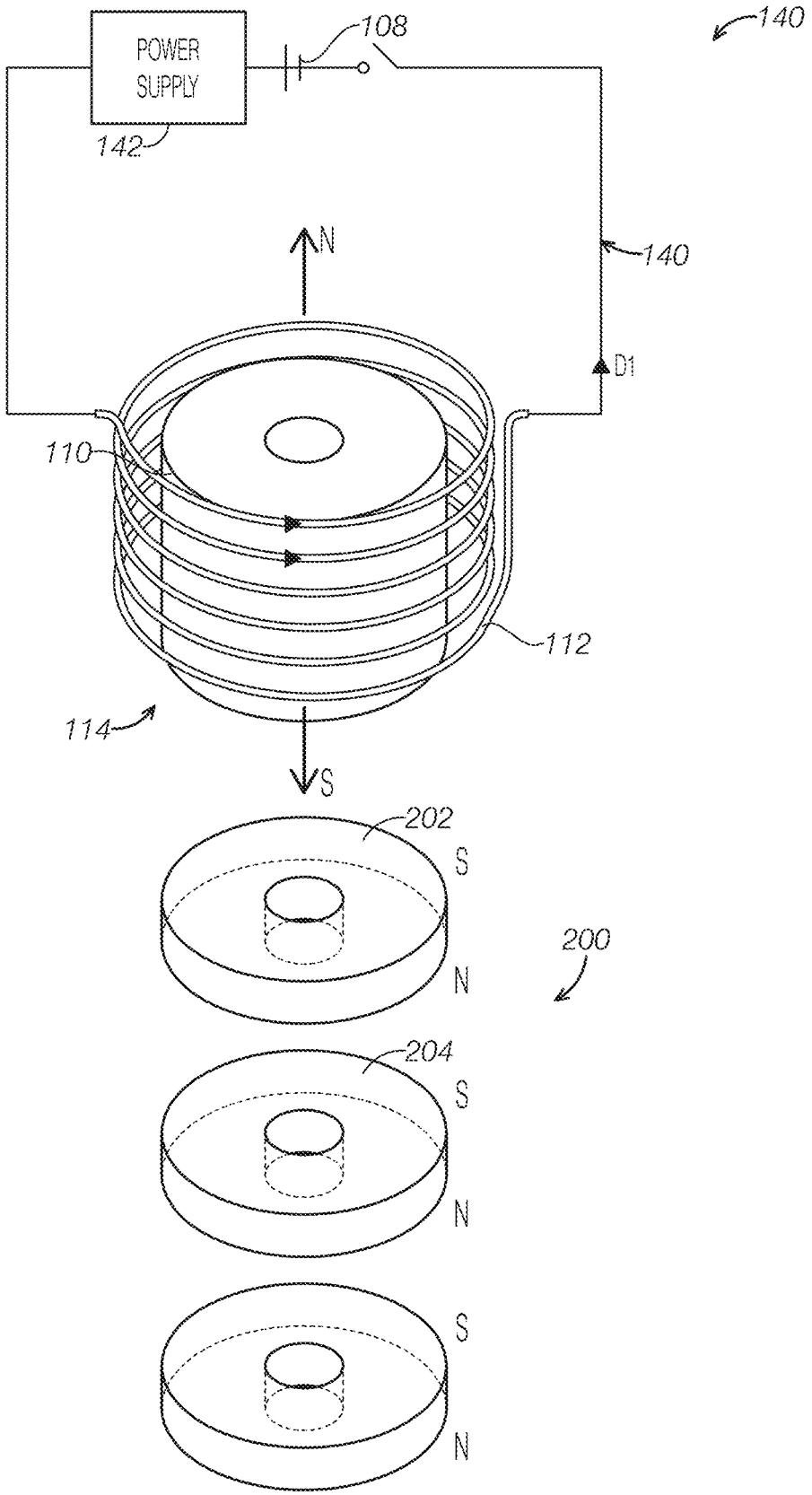
FIG. 2 shows an electromagnet of a holding tool placed over a stack of permanent magnets, illustrating a polarity of the electromagnet and a polarity of the permanent magnets at a stack.

FIG. 2 shows an electromagnet 114 of holding tool 100 placed over a stack of permanents 200, illustrating a polarity of the electromagnet and a polarity of the permanent magnets at a stack 200. Electromagnet 114 may be connected to a power supply 140. As described above, electromagnet 114 includes a coil 112 and a hollow member 110 which is a core of electromagnet 114. Hollow member 110 may be made of any suitable ferromagnetic material and have any suitable size and shape to generate desired magnetic field when a current pass through coil 112. For example, hollow member 110 may be made from ferromagnetic material such as iron or ferromagnetic compounds such as ferrites. In some embodiments, hollow member 110 may be of cylindrical shape with an inner wall having a shape similar to that of a permanent magnet to be selected. The size and shape of hollow member may be configured to generate a desired pull force during an operation of the holding tool. For example, there is a net pull force resulting from electromagnet 114 and a permanent magnet received in the holding tool (e.g., first permanent magnet 202) when the first permanent magnet 202 is picked up. The net pull force from the holding tool is desired to be small so that the holding tool can be easily moved away from stack 200.

Continuing with FIG. 2, an electrical circuit 140 of electromagnet 114 may include a coil 112, a power supply 142, and a switch 108. Power supply 142 may provide a current over a specific range and control output current at a specific value. A circuit of power supply may include various electronic components such as transformer, resistance, capacitator, diode to vary the voltage and control the current. For example, power supply 142 may have adjustable output voltage to deliver a current at specific value. Circuit 140 of power supply 142 may include an electronic output current limiter that controls the output current, which may vary from a few milliamperes to a few amperes, for example. Power supply 142 may be a device conventionally used in the art. Circuit 140 may be configured to have power supply 142 to supply a current in a first direction and a second direction reversal to the first direction. Switch 108 may control the direction of the current in the electrical circuit 140. As shown in FIG. 2, electromagnet 114 may have north pole N pointed up and south pole S pointed down when energized or the current passes through coil 112 at the first direction D1. When the current passes through coil 112 at the second direction, electromagnet 114 may have north pole N pointed down and south pole S pointed up (not shown).

In some applications, holding tool 100 may be used to pick up a permanent magnet from stack 200. The permanent magnet to be picked up may be referred as a first permanent magnet 202. Stack 200 may include high strength permanent magnets. For example, the permanent magnets in stack 200 may be neodymium magnets having a grade greater than N35. In another example, the permanent magnets in stack may have strength less than neodymium magnet N35 but may have a larger size to generate significant magnetic force. It should be appreciated that the permanent magnets may be magnets with any strength. FIG. 2 shows that each permanent magnet in stack 200 has a south pole facing up. In other words, the permanent magnets of the stack have a polarity. In the operation of holding tool 100, electromagnet 114 is not energized when holding tool 100 is moved to stack 200. When first permanent magnet 202 is received in holding portion 104 (i.e., ferromagnetic hollow member 110), there are attraction between hollow member 110 and first permanent magnet 202. Nevertheless, the attraction is much less than the attraction between first permanent magnet 202 and a second permanent magnet 204 or the attraction from stack 200. Thus, it is difficult to move holding tool 100 away from stack 200. To facilitate the picking up of first permanent magnet 202, electromagnet 114 may be energized in first direction D1. Magnetic field thus generated is opposite the magnetic field from second permanent magnet 204 or the permanent magnets in stack 200. That is, the electromagnet 114 has a polarity opposite to a polarity of the permanent magnets in stack 200. In other words, the net pull force from holding tool 100 with received first magnet 202 when electromagnet 114 energized at the first current is less than a pull force from holding tool 100 with received first permanent magnet 202 when electromagnet 114 is not energized. In some embodiments, electromagnet 114 may be configured to have its magnetic field counter off the magnetic field of first magnet 202 substantially such that holding tool 100 with received first permanent magnet has substantial zero net pull force or small net pull force. In other words, the net magnet field from electromagnet 114 and the received first permanent magnet 202 are substantially contained in holding tool 100. Thus, there is no net pull force or substantially reduced net pull force from holding tool 100 or holding tool 100 may possess characteristics of non-ferrous material. In this way, holding tool 100 carrying first permanent magnet 202 can be easily moved away from stack 200.

Figure 3:
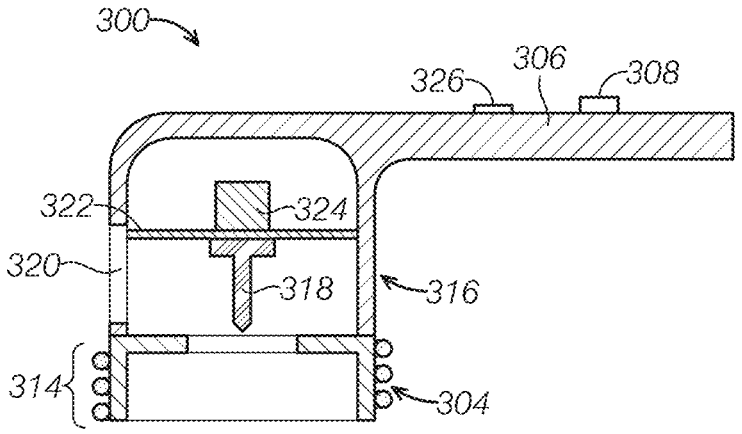
FIG. 3 illustrates an example holding tool according to a second embodiment of the present disclosure.

FIG. 3 illustrates an example holding tool 300 according to a second embodiment of the present disclosure. Holding tool 300 may include a holding portion 304, a loading portion 316, a handle portion 306 and a switch 308. Holding portion 304 may include an electromagnet 314 similar to the electromagnet described above associated with FIGS. 1-2. For the sake of brevity, similar components will not be described in detail. In some embodiments, loading portion 316 and handle portion 306 may be integrally formed. A fastener 318 may be loaded from slot 320 automatically or manually and may be kept in fastener holder 322. A container 324 including explosive mixture may be disposed on fastener 318. Container 324 may be loaded into holding tool 300 after fastener 318 is loaded or may be attached to fastener 318 and then loaded into holding tool 300 along with fastener 318. The explosive mixture may be ignitable gas or powder conventionally used in a tool to drive a fastener using explosive force. An ignition trigger 326 may be disposed on handle portion 306. When trigger 326 is activated, a force generated from explosion may push fastener 318 slide through a hole of a permanent magnet received in holding portion 304 so that the permanent magnet is secured to a predetermined position via fastener 318.

Figure 4:
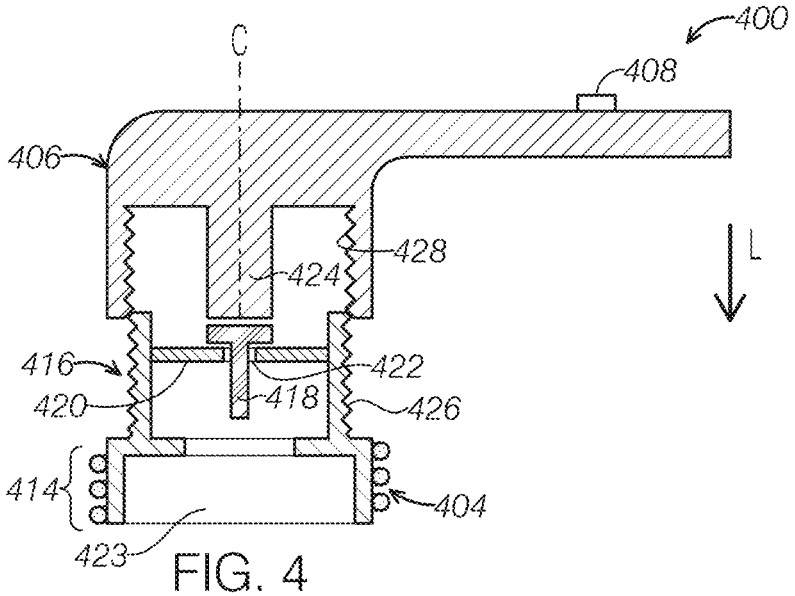
FIG. 4 illustrates an example holding tool according to a third embodiment of the present disclosure.

FIG. 4 illustrates a holding tool 400 according to a third embodiment of the present disclosure. Holding tool 400 may include a holding portion 404, a loading portion 416, a handle portion 406 and a switch 408. Holding portion 404 may include an electromagnet 414 similar to the electromagnet described above associated with FIGS. 1-2. For the sake of brevity, similar components will not be described in detail. In the depicted embodiment, handle portion 406 may include a driver head 424 disposed along a central axis C of holding tool 400 in the direction L. Driver head 424 may be integrally formed with handle portion 406. In some embodiments, the portion 406 may include an electrical driver to drive fastener 418 down automatically (not shown).

Loading portion 416 may include a fastener holder 420 having an aperture 422. A diameter of aperture 422 may be smaller than a diameter of fastener head of a fastener 418. At least portion of fastener holder 420 surrounding aperture 422 may be made from elastic material so that fastener 418 may pass through aperture 420 when fastener 418 is loaded from an opening 423 of holding portion 404 and then held on fastener holder 420. Alternatively, when fastener 418 is made from a magnetic material such as iron, a magnet may be attached to an end of driver head 424 (not shown). Fastener 418 may be loaded from the opening of holding portion 404 and held to the magnet. In this embodiment, fastener holder is not needed.

Loading portion 416 may be connected with handle portion 406 via tread connection. Loading portion 416 may include threads 426 at a location adjacent to handling portion 406 while handle portion 406 may include complementary treads 428. Handle portion 406 may be rotated down along the pitch of the threads. Driver head 424 may press fastener 418 into a hole of a permanent magnet received in holding portion 404 as handle portion 406 is rotated down. In this way, the permanent magnet can be secured to a predetermined position via fastener 418.

Figure 5:
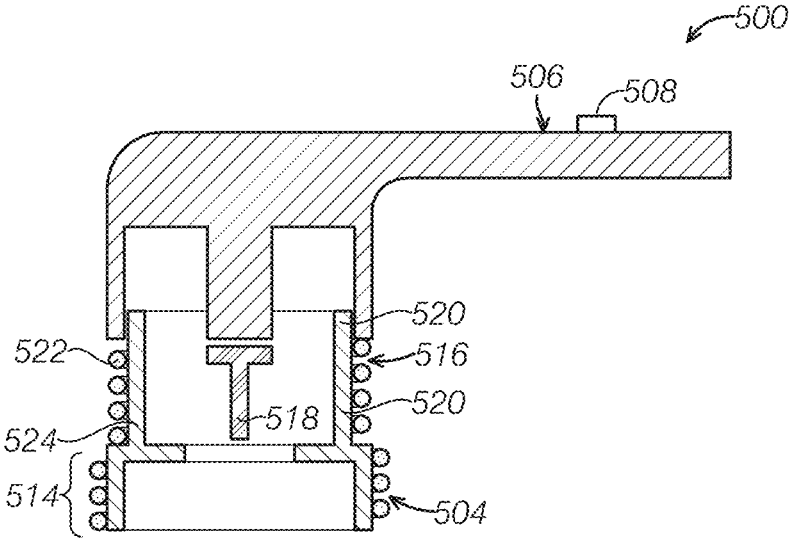
FIG. 5 illustrates an example holding tool according to a fourth embodiment of the present disclosure.

FIG. 5 illustrates a holding tool 500 according to a fourth embodiment of the present disclosure. Holding tool 500 may include a holding portion 504, a loading portion 516, a handle portion 506 and a switch 508. Holding portion 504 may include an electromagnet 514 similar to the electromagnet described above associated with FIGS. 1-2. For the sake of brevity, in this example, the elements and features similar to those previously shown and described will not be described in further detail. A fastener 518 may be loaded automatically or manually as described above. Loading portion 516 may be slidably connected with handle portion 506. Loading portion 516 may be formed as a thin-walled tube. One end of loading portion 516 may be fixed to holding portion 504 and an upper segment 520 of loading portion 516 may be disposed inside handle portion 506. A spring 522 may be disposed around a lower segment 524 of loading portion 516. Spring 522 may be a coil spring or a rubber spring. Handle portion 506 may slide down under a force and press fastener 518 into a hole of a permanent magnet received in holding portion to secure the permanent magnet at a predetermined place via fastener 518. Once the force is released, handle portion 306 returns to its original position by a spring force.

Figure 6A:
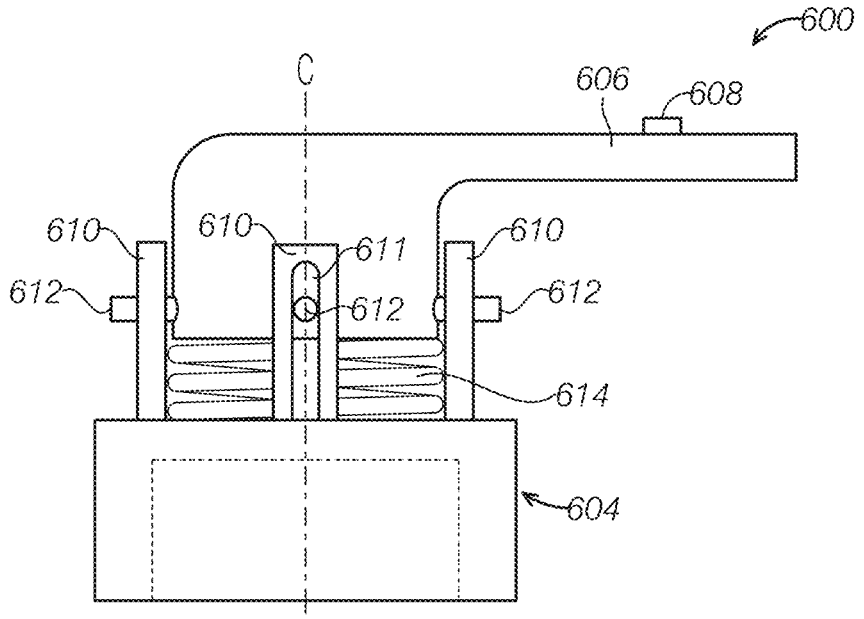
FIG. 6A shows a side view of an example holding tool according to a fifth embodiment of the present disclosure.
Figure 6B:
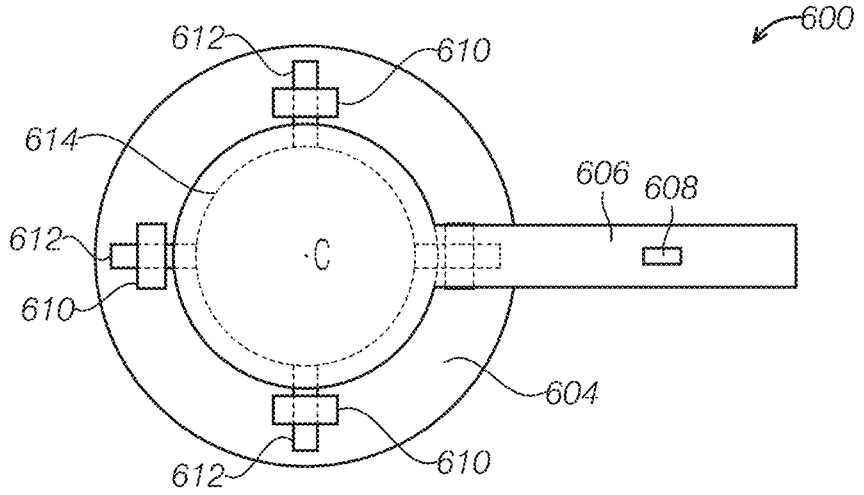
FIG. 6B shows a top view of the holding tool in FIG. 6A.

FIG. 6A shows a side view of a holding tool 600 according to a fifth embodiment of the present disclosure. FIG. 6B shows a top view of holding tool 600. Holding tool 600 may include a holding portion 604, a handle portion 606 and a switch 608. Holding portion 604 may include an electromagnet (not shown) similar to the electromagnet described above associated with FIGS. 1 and 2. A fastener may be loaded manually or automatically as described above (not shown). For the sake of brevity, the elements and features similar to those previously shown and described will not be described in further detail. Handle portion 606 and holding portion 604 may be slidably connected via a plurality of sliders 610. Sliders 610 may be a plate having an elongated slot 611 and sliders 610 may be fixed on holding portion 604. A plurality of pins 612 corresponding to sliders 610 may be fixed to handle portion 606, disposed in slots 611 of sliders 610 and capable of sliding in slots 611. A spring 614 may be provided to enclose a central axis C of holding tool 600 (see FIG. 6B). Handle portion 606 may be positioned on spring 614 so that it can be moved down by a force and returned to an original place when the force is release. In this way, handle portion 606 can push a preload fastener into a permanent magnet received in holding portion 604. The depicted embodiment shows four sliders 610. However, it should be appreciated that a holding tool may include different numbers of slides such as two or three sliders.

Figure 7A:
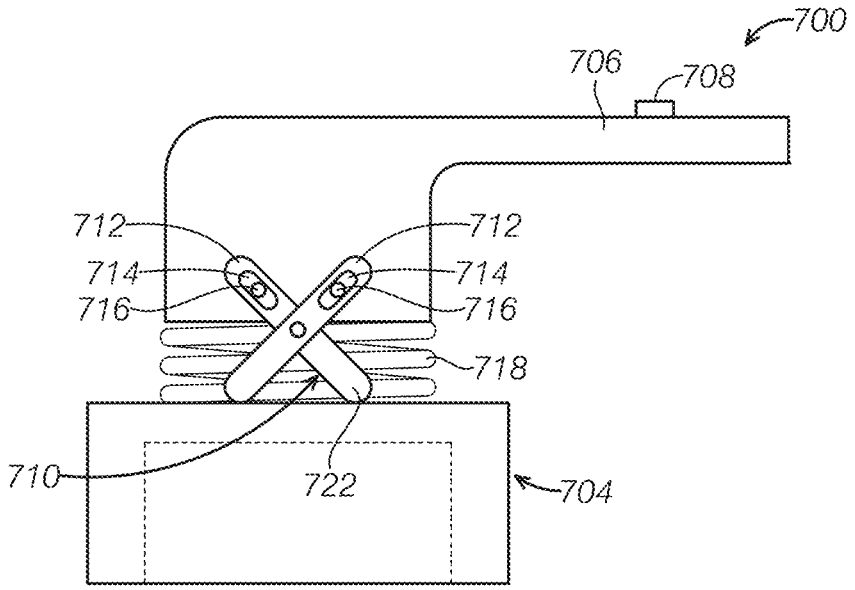
FIG. 7A shows a side view of an example holding tool according to a sixth embodiment of the present disclosure.
Figure 7B:
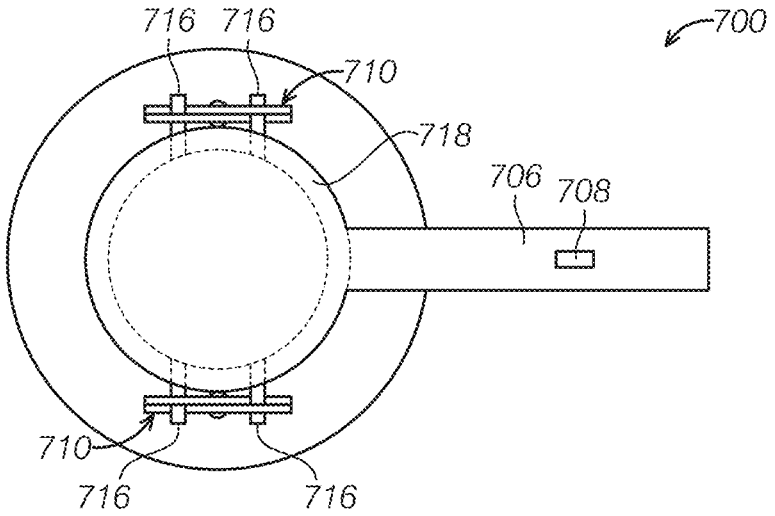
FIG. 7B shows a top view of the holding tool in FIG. 7A.
Figure 7C:
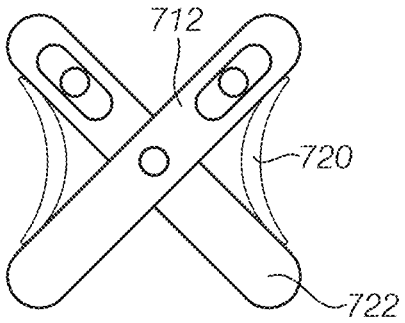
FIG. 7C shows an alternative embodiment of a spring in FIG. 7A.
Figure 7D:
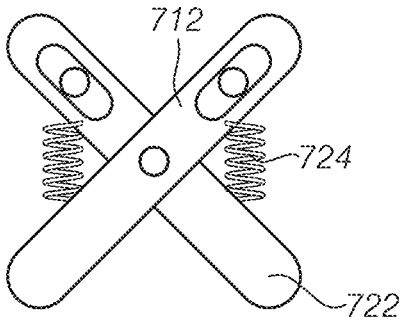
FIG. 7D shows another alternative embodiment of spring in FIG. 7A.

Referring to FIGS. 7A and 7B, FIG. 7A shows a side view of a holding tool 700 according to a sixth embodiment of the present disclosure. FIG. 7B shows a top view of holding tool 700. Holding tool 700 may include a holding portion 704, a handle portion 706 and a switch 708. Holding portion 704 may include an electromagnet similar to the electromagnet described above associated with FIGS. 1 and 2. A fastener may be loaded manually or automatically as described above. For the sake of brevity, the elements and features similar to those previously shown and described will not be described in further detail. Handle portion 706 and holding portion 704 may be slidably connected via a plurality of scissors 710. Each of lower legs 722 of scissors 710 may be fixed on holding portion 704. Each of upper legs 712 of scissor 710 may include a slot 714 to receive a pin 716. Pin 716 may be fixed to handle portion 706, and capable of sliding in slot 714. A spring 718 may be disposed to enclose a central axis C of holding tool 700 (see FIG. 7B). Handle portion 706 can be moved down by a force and returned to an original place by a spring force when the force is release. In this way, handle portion 706 can push the preload fastener into a permanent magnet received in holding portion 704. Alternatively, a spring may have different configurations. FIG. 7C shows an alternative embodiment in which a leaf spring 720 may be disposed between each pair of upper leg 712 and lower leg 722 of scissor 710. In this embodiment, spring 718 is not needed. FIG. 7D shows another alternative embodiment in which a coil spring 724 may be disposed between each pair of upper leg 712 and lower leg 722 of scissor 710. In this embodiment, spring 718 is not needed.

The embodiment depicted in FIG. 7B shows two scissors 710. It should be appreciated that a holding tool may include different numbers of scissors such as three or four scissors evenly disposed along a perimeter of cross-section area of holding portion 704.

Figure 8:
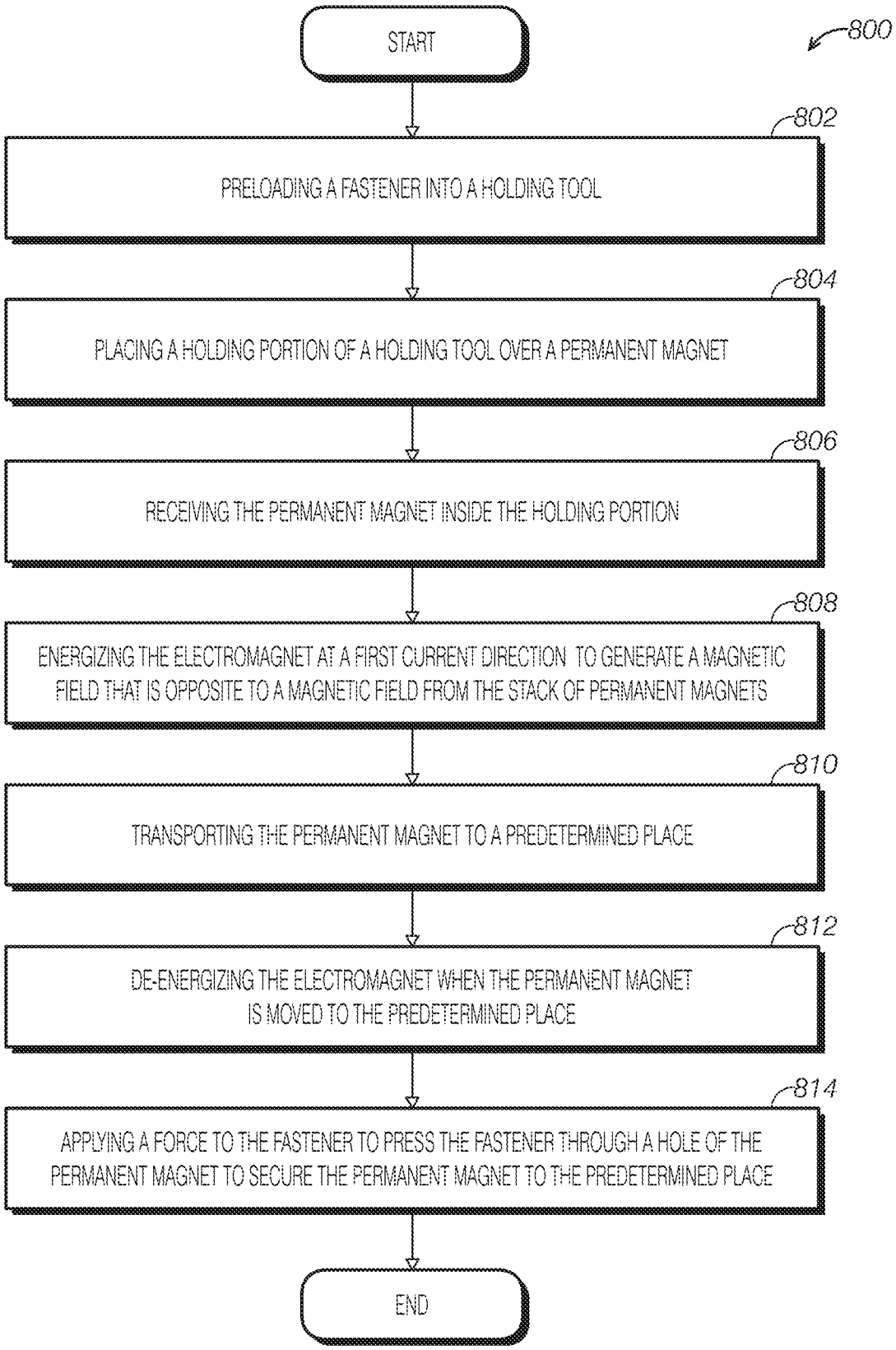
FIG. 8 is a flowchart of method to select a permanent magnet from a stack of permanents and move the permanent magnet to a predetermined place using a holding tool of the present disclosure and secure the permanent magnet on the predetermined place.

FIG. 8 is a flowchart of method 800 to select a permanent magnet from a stack of permanent magnets, move and secure the received permanent magnet to a predetermined place using a holding tool of the present disclosure. Method 800 may be implemented by holding tools described in FIGS. 1-7. The holding tool may comprise a holding portion including an electromagnet, a loading portion to preload a fastener, a handle portion, and a switch to energize and de-energize the electromagnet. At 802, method 800 may include preloading a fastener into the holding tool. Next, at 804, method 800 may include placing the holding portion over a permanent magnet located at a stack of permanent magnets. The permanent magnet may be referred as a first permanent magnet in the stack. The permanent magnets in the stack may have high strength. It should be appreciated that the permanent magnets may be stored on the stack or may be stored at a pile of permanent magnets or any storage place where permanent magnets are located adjacent to each other. At 806, method 800 may include receiving the permanent magnet inside the holding portion.

Although the permanent magnet is received in the holding portion of the holding tool, it may be difficult to move the permanent magnet away from its stored position because of attraction from other permanent magnets surrounding or adjacent to the permanent magnet. Thus, at 808, method 800 may include energizing the electromagnet at holding portion at a first current direction to generate a magnetic field that is opposite to a magnetic field from the stack of permanent magnets. In other words, the electromagnet energized at the first current direction has a polarity opposite to a polarity of the permanent magnets in the stack. When the electromagnet is energized, the attraction force between the holding tool loaded with the permanent magnet and the stack of permanent magnet is reduced. In some embodiments, the electromagnet may be configured to reduce a net pull force from the holding tool loaded with the permanent magnet to be substantially zero or to a predetermined level. The predetermined level may be a level that a user of the holding tool feels negligible attraction between the holding tool and the stack of the permanent magnets.

Next, at 810, method 800 may include moving the permanent magnet away from the stack of permanent magnets and transporting the permanent magnet to the predetermined place. In some embodiments, the electromagnet may be de-energized during the transportation process to save energy and reduce the heat in the electromagnet. In some embodiments, an electric circuit may be configured to deliver different amount of currents to the electromagnet. For example, the holding tool may include a plurality of operation modes that provide different amount of current at each mode. For example, the switch may include a picking up button for a selection mode, a transportation button for the transportation mode and a fixation button for securing mode. During the transportation, the transportation button may be activated to deliver less amount of current to the electromagnet to reduce the pull force from the permanent magnet. Such approach is advantageous in the environment having parts made from magnetic material such iron and steel. For example, the permanent magnet may be fixed on a hinge of a vehicle door. The holding tool loaded with the permanent magnet may be attracted to the metal parts of the vehicle. Keeping electromagnet energized with the current at a lower level in the first direction can reduce the net pull force from the holding tool to prevent it from being attracted to metal parts while saving energy.

Next, at 812, method 800 may include de-energizing the electromagnet when the permanent magnet is moved to the predetermined place. In the de-energized condition, the permanent magnet may be attracted to the predetermined place without the countering magnetic field from the electromagnet. In some embodiments, the electromagnet may be energized by delivering a current at a second direction reversal to the first direction so that the holding tool can be attracted to a workpiece to be connected with the permanent magnet. Once the permanent magnet is at the predetermined position at the workpiece, method 800 may include applying a force on the fastener to press the fastener through a hole of the permanent magnet to secure the permanent magnet to the predetermined place of workpiece.

Method 800 allows an operator to select a high strength permanent magnet from a stack of permanent magnets easily without an effort or with less effort to overcome the attraction force between the holding tool loaded with the permanent magnets and the stack of permanent magnets. Further, the selected permanent magnets can be secured on a predetermined place using the same holding tool.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A holding tool to handle a first permanent magnet in a stack of permanent magnets, comprising:

a body including a holding portion, wherein the holding portion includes a hollow member made of ferromagnetic material and a coil surrounding the hollow member, wherein the hollow member and the coil form an electromagnet and the electromagnet is configured to, when energized in a first current direction, have a polarity opposite to a polarity of the permanent magnets in the stack; and a switch disposed on the body and electrically connected to an electrical circuit of the electromagnet and configured to energize the electromagnet by connecting the electrical circuit and de-energize the electromagnet by disconnecting the electrical circuit;

wherein a current in the coil, size and shape of the hollow member are configured to generate a magnetic field to reduce a net pull force resulting from the first permanent magnet received in the holding portion and the electromagnet to facilitate movement of the holding tool loaded with the first permanent magnet away from the stack.

2. The holding tool of claim 1, wherein the body further comprises a handle portion and a loading portion and wherein the loading portion is disposed between the handle portion and the holding portion and configured to preload a fastener.

3. The holding tool of claim 2, wherein the loading portion includes at least one section elastically deformable or includes an accordion-shaped section along a lengthwise direction of the holding tool, and wherein the loading portion deforms when a force applies via the handle portion so that the fastener is capable of being pushed through a hole of the first permanent magnet.

4. The holding tool of claim 2, further comprising a container attached to the fastener and preloaded into the loading portion, wherein the container includes an explosive mixture and an ignition of the mixture pushes the fastener into a hole of the first permanent magnet.

5. The holding tool of claim 2, wherein the handle portion is connected to the loading portion via thread connection and wherein rotation of the handle portion drives the handling portion down against the fastener and pushes the fastener into a hole of the first permanent magnet.

6. The holding tool of claim 2, further comprising a spring between the handle portion and the holding portion and enclosing the loading portion, wherein the loading portion is formed as a thin-walled tube fixed on the holding portion and slidably connected to the handle portion, wherein the handle portion is configured to be capable of sliding down and up along the tube.

7. The holding tool of claim 2, wherein the loading portion includes a plurality of sliders fixed on the holding portion, and each slider has an elongated slot to receive a pin that is connected to the handle portion such that the handling portion is capable of moving up and down via movement of the pins in the slots, and wherein a spring is provided between the handle portion and the holding portion.

8. The holding tool of claim 2, wherein the loading portion includes a plurality of scissors, lower legs of scissors are fixe on the holding portion and each of upper legs of scissors has an elongated slot to receive a pin that is connected to the handle portion such that the handle portion is capable of moving up and down via movement of the pins in the slots, and wherein a spring is provided to return the handle portion to an original position when a force applied by the handle portion is released.

9. The holding tool of claim 2, wherein the loading portion includes a fastener holder to keep the fastener at a position above the holding portion and the fastener is manually loaded on the fastener holder.

10. The holding tool of claim 2, further comprising an automatic fastener loader to feed the fastener via a slot in the loading portion automatically.

11. A holding tool to handle a first permanent magnet from a stack of permanent magnets, comprising:

a DC power supply, a holding portion to receive and hold the first permanent magnet, including:

a hollow member made of ferromagnetic material and a coil surrounding the hollow member and forming an electrical circuit with the DC power supply, wherein the hollow member and the coil form an electromagnet and the electromagnet is configured to, when energized at a first current direction, have a polarity opposite to a polarity of the permanent magnets in the stack;

a loading portion connected to the holding portion and configured to preload and hold a fastener above the holding portion;

a handle portion connected to the loading portion and configured to apply a force to the fastener; and a switch disposed on the handle portion and configured to energize the electromagnet by connecting the electrical circuit and de-energize the electromagnet by disconnecting the electrical circuit.

12. The holding tool of claim 11, wherein the electrical circuit is configured to be capable of delivering a first current at different magnitudes and delivering a second current at a second current direction reversal to the first current direction, wherein the switch includes a plurality of options and each option delivers a specific amount of current so that a net pull force from the electromagnet and the first permanent magnet received in the holding portion is different at the different options.

13. The holding tool of claim 11, wherein the loading portion, the handle portion and the fastener are made from non-ferromagnetic materials.

14. The holding tool of claim 11, wherein the first permanent magnet is a neodymium magnet having a grade greater than N35.

* * * * *